United States Patent [19]

Erickson

[11] 4,285,548

[45] Aug. 25, 1981

[54] UNDERGROUND IN SITU LEACHING OF ORE

[76] Inventor: Jalmer W. Erickson, P.O. Box 3561, Casper, Wyo. 82602

[21] Appl. No.: 93,904

[22] Filed: Nov. 13, 1979

[51] Int. Cl.[3] ..... E21B 43/28; E21C 41/14

[52] U.S. Cl. ..... 299/2; 299/4

[58] Field of Search ..... 299/2, 4; 166/50

[56] References Cited

U.S. PATENT DOCUMENTS

| | | | |
|---|---|---|---|
| 1,660,818 | 2/1928 | Ranney | 299/2 |
| 3,309,140 | 3/1967 | Gardner et al. | 299/4 |
| 3,309,141 | 3/1967 | Fitch et al. | 299/4 |
| 3,713,698 | 1/1973 | Rhoades | 299/4 |
| 4,160,481 | 7/1979 | Turk et al. | 299/2 X |

OTHER PUBLICATIONS

Davis & Reed, "Controlling Uranium Solution Mining Operations", Mining Congress Journal, Oct. 1978, pp. 35–38.

*Primary Examiner*—Ernest R. Purser

*Attorney, Agent, or Firm*—Sheridan, Ross, Fields & McIntosh

[57] ABSTRACT

An underground method for in situ leaching of mineral resource bodies is used to recover the mineral. The method comprises running a drift close to the resource body in such a manner as to minimize any effect on subsurface water; drilling long holes from the drift into the resource body at intervals which are determined by the character of the resource body; perforating the long holes and capping the long holes at the drift end with valves; injecting a recovery solution into a portion of the long holes and recovering the recovery solution from another portion of the long holes. The entire development of the drifts and long holes and the conduction of the recovery solution are done in such a manner as to minimize any effect on the subsurface water table or hydrostatic pressure. The spacing of the long holes is selected so as to maximize the exposure of the resource body to the recovery solution. The method permits the alteration of the flow of the recovery solution through the resource body, thereby allowing for maximum exposure of the resource body to the recovery solution.

20 Claims, 7 Drawing Figures

Fig. 1
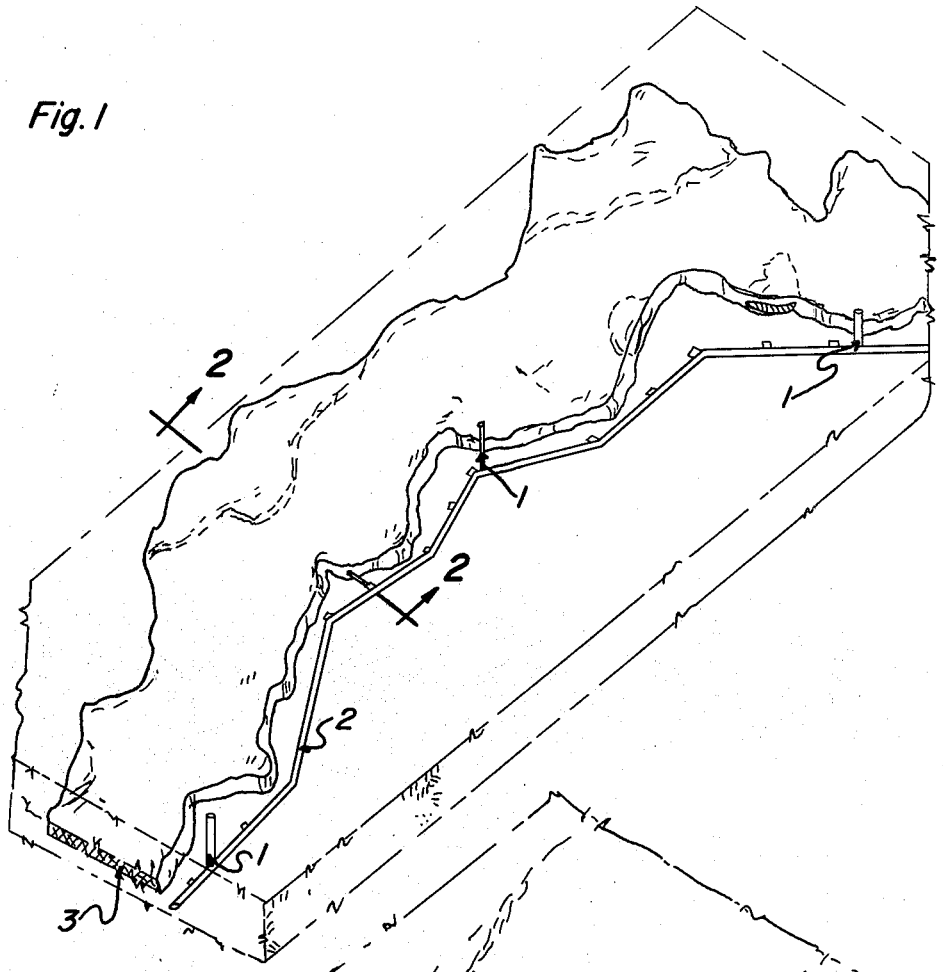
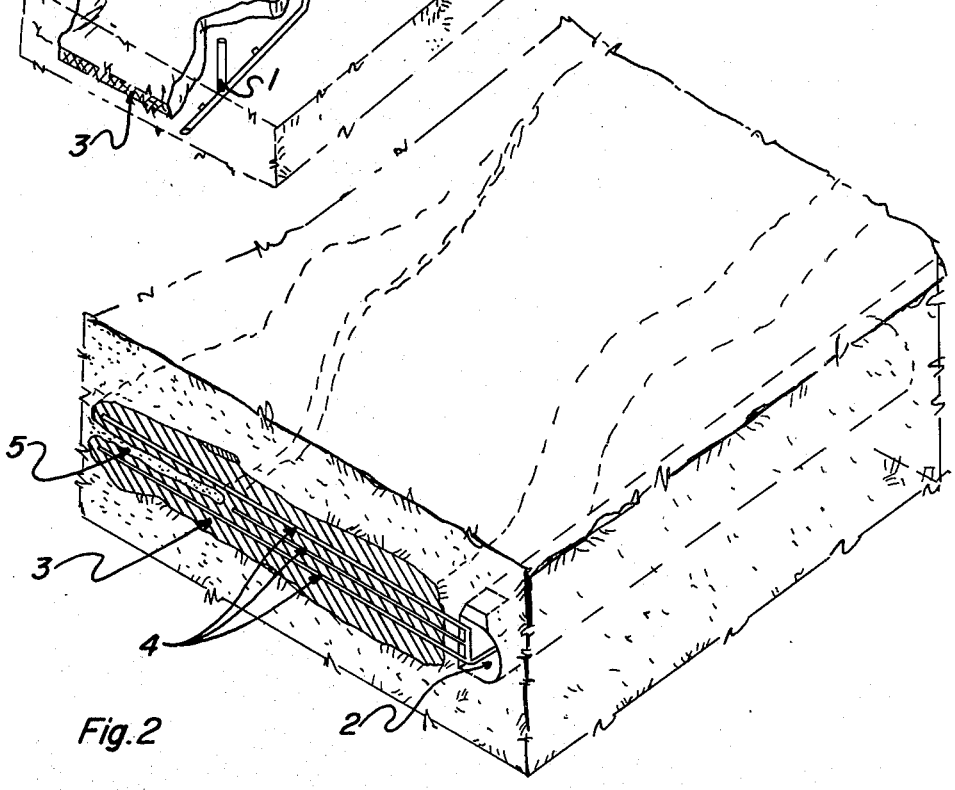
Fig. 2

UNDERGROUND IN SITU LEACHING OF ORE

DESCRIPTION

1. Technical Field

The process of the present invention relates to an underground in situ leaching of a mineralized resource body. It is especially applicable to the underground in situ leaching of a uranium resource body.

2. Background Art

In its natural form uranium is quite soluble in water and under common atmospheric and hydrospheric conditions the mineral is constantly concentrated and dispersed in many of the common igneous and sedimentary rocks. As a result, uranium is generally found weakly dispersed through permeable rocks, especially the more permeable sedimentary rocks. Thus, many of the new uranium deposits being discovered are of low grade and/or too small to warrant their mining by conventional means. The search for uranium has increased to depths of greater than 500 feet in an attempt to find higher grade deposits. However, unless deposits at such depths are of a high grade and of substantial size, it is doubtful that conventional mining methods can economically recover the ore.

There are three principle conventional techiques for the recovery of uranium which are currently in use. They are open pit or strip mining, underground mining and surface leaching of the uranium deposit. Open pit mining will recover the maximum pounds of uranium from within the confines of the pit. This technique is generally directed toward the recovery of the uranium contained in an ore body as opposed to the entire resource body. Hence, the uranium contained in outlying mineralized areas will not be recovered. This mining technique has the greatest adverse impact on the ground's surface and subsurface and on the underground water. Additionally, it produces and exposes the miners to the most radiation. Although the damage to the surface and subsurfaces can be corrected, the adverse effect on the underground water supply, for example, contamination and diversion of the water supply, cannot be corrected. As a result, this method of mining has the greatest negative environmental impact. The adverse environmental impact taken in conjunction with the grade, thickness, size and depth of the deposit, and the availability of conventional mining often makes this technique uneconomical and environmentally unacceptable.

Conventional underground mining requires that drifts be made below, near or through the ore body and that these drifts be continuously drained of water. Long holes are then drilled from the drifts up into the ore body in order to drain the ore body of its water. Thereafter, the ore is removed from the ore body, transported up to the surface, then to a mill where it is subsequently processed. Because this technique is directed at the ore body, it only extracts the relatively thick and the relatively high grade uranium of the resource body. As a result, this method obtains only a low percentage recovery of the total pounds of uranium in the ground. Moreover, this method also has an adverse environmental impact on the ground's subsurface and the underground water flow. It not only disrupts and drains the underground water flow but it often contaminates its by intermingling the water of the ore body area with that of another level of water which may have been potable. Additionally, this method results in the production of and the exposure of miners to a fairly high amount of radiation and it is the most hazardous form of uranium mining with respect to miners' safety.

After the underground mining has removed the bulk of the richer portions of the ore body, secondary leaching may be instituted by using the long holes which go from the drifts to the ore body as the injection and recovery means. However, this secondary leaching is generally very ineffective due to the fact that it is only conducted within a small area of the total resource and it is conducted through unsaturated, i.e., drained, sand. Due to the draining of the water from the ore body, it is extremely difficult to control the flow of the leaching solution and to prevent its channeling through the more permeable areas of the ore body.

Surface leaching of uranium ore deposits offers a viable approach for obtaining uranium from resource bodies having relatively low grade and shallow deposits of uranium. The surface damage caused by surface in situ leaching is minimal and is easily rehabilitated. Moreover, no radioactive waste is brought to the surface. However, the technique still has an adverse effect upon subsurface water and the intermingling of surface waters. This technique does not provide for a very controlled leaching of the resource body. This lack of control is due to a variety of interacting factors which cause the leaching solution to be channeled through the resource body. Such factors include a relatively inflexible pattern of injection and recovery wells which is based upon the character of the resource body as a whole. The pattern does not take into consideration the wide variations which occurs in the lithology, porosity and permeability of the resource body. Moreover, with surface leaching it is extremely difficult to determine the head pressures of each well and to control the pressure throughout the entire system. The control of head pressures of the wells is aggravated by calcium carbonate or other forms of plugging of the sands of the resource body and by the fact that no attempt is made to maintain the hydrostatic pressure originally present around the resource body. These factors result in an inability to prevent or correct channeling of the leaching solution, thereby reducing the exposure of the uranium to the leaching solution. It can also result in the excursion of chemicals used in the process to areas outside of the ore body being leached.

The leaching process of the present invention provides a more controlled flow of the leaching solution through the entire uranium resource body, not just the ore body. It also provides a more economical and energy efficient means for recovering uranium from the entire uranium resource body with minimal impact on the environment.

DISCLOSURE OF THE INVENTION

The process of the present invention entails underground in situ leaching of a uranium resource body to recover uranium values. The entire process is conducted in such a manner as to minimize any effect on underground hydrostatic pressure or on the water table. The method comprises running a drift along, above or below the resource body and, as much as is possible, the drift is run outside of the resource body; drilling long holes from the drift into the resource body, perforating the long holes and putting a control valve on the long holes at their drift ends; injecting a recovery solution into the resource body through a portion of the long holes and recovering the recovery solution containing soluble uranium from another portion of the long holes; and processing the recovery solution containing soluble uranium to recover the uranium.

The spacing of the long holes is dependent upon the lithology, porosity and permeability of the section of resource body being leached and will be from about every 15 to about 40 feet of the drift. To determine the spacing of long holes for a particular resource body, the long holes, as they are drilled, are analyzed by probing and logging in order to determine the lithology, porosity and permeability of that particular area of the resource body. The spacing of the long holes is then selected to maximize the exposure of the resource body to the recovery solution.

By minimizing the effect of this process upon the hydrostatic pressure of the resource body while preserving the water table, it is possible to maintain the fluid saturation of the sands of the resource body. The hydrostatic maintenance of the saturated sands helps to prevent the channeling of the recovery solution through the more permeable zones to the exclusion of the less permeable zones of the resource body. Hence, the maintenance of the saturated sand maximizes the surface area available for contact with the recovery solution, thereby providing for a more effective leaching of uranium from the resource body.

The use of the control valved long holes for the injection and recovery of the recovery solution permits the flow of the recovery solution through the resource body to be controlled. Each long hole can be used interchangeably for the injection or recovery of the recovery solution; the valves on the recovery holes can be adjusted to obtain an even recovery of the recovery solution; and specific injection and recovery long holes can be shut off. The ability to control the fluids being conducted through the resource body permits maximum exposure of the uranium in the resource body to the recovery solution thereby maximizing the recovery of the uranium.

BRIEF DESCRIPTION OF THE DRAWINGS

FIG. 1 is a plan view of the positioning of a drift along the front of a uranium resource body.

FIG. 2 is a section of the resource body depicted in FIG. 1.

BEST MODE FOR CARRYING OUT THE INVENTION

Figure 3:
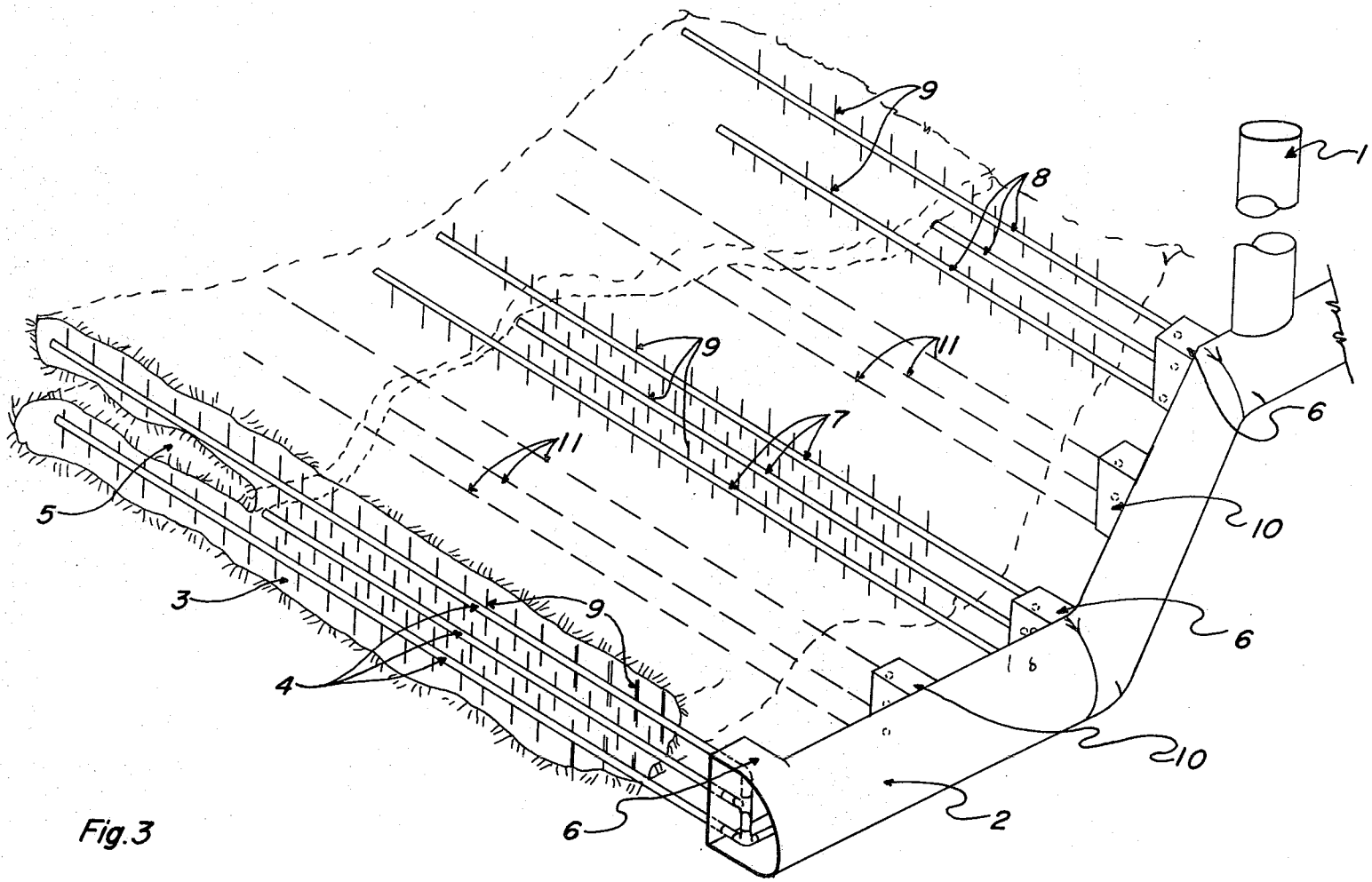
FIG. 3 is a schematic layout of a drift and long holes for the underground leaching of a section of a one level roll front uranium resource body.

The process of the invention is applicable to the mining of uranium deposits located within permeable sedimentary or igneous rock which are associated with geochemical, for example, redox, interfaces or stratiform mineral accumulations. It is applicable to the mining of either high grade or low grade uranium deposits; however, the uranium deposit must be below the water table.

For the purposes of this invention, the term resource body means a body of mineralization containing uranium which includes both the relatively low grade and relatively high grade uranium. The term ore body refers to that portion of the resource body wherein the uranium is of a relatively high grade and thickness and is, therefore, that portion of the resource body wherein the uranium is the most concentrated.

The term recovery solution as used herein refers to those solutions which are injected into the resource body which enable the recovery of the desired mineral values. The recovery solution will include any solutions or agents used to precondition the mineral values to place them in a form which is soluble in the leaching solution and it will include any solutions used to leach the mineral values from the resource body. Recovery solution also includes any rehabilitative solutions needed to be injected into the resource body to restore it after the leaching process.

In order to create the drift used in the process of the present invention, it is necessary that a minimum of two shafts be drilled to the desired level of the drift. The actual placement of the shafts is dependent upon the location of the drift for which the shaft provides access. For example, when the drift is run along the side of the resource body, it is preferred that the shafts are run along the same side of the resource body. The total number of shafts drilled is dependent upon the length of the resource body and upon ventilation and access requirements of the mining drift.

The shafts are drilled in such a manner as to minimize any effect on subsurface hydrostatic pressure and to preserve the subsurface water tables. Thus, any drilling technique which minimizes the disturbance of subsurface waters may be used, for example, reverse circulation drilling. In order to minimize the effect on subsurface waters, it may be necessary to seal, for example, by drilling muds or grouting, the shaft as it is drilled. In order to maintain the natural water tables and the hydrostatic pressure, the shafts are lined, for example, with metal, and the liner is cemented in place.

Generally, one shaft, which will be used as the primary access to the drift, is drilled first. From this shaft the drift is dug. The additional shafts are then drilled either down to the drift or up from the drift to the surface, as they are needed. Obviously, two shafts can be drilled concurrently with the drift being dug from one shaft to the other shaft or with the drift being dug simultaneously from both shafts.

The inside diameter of the shafts will be dependent upon the use of the shaft. When the shaft is a primary access means to the drift, then the inside diameter of the finished shaft will be from about 8 to about 12 feet. A shaft used for ventilation and as an escape shaft from the drift will have a finished inside diameter of from about 5 to about 8 feet. The diameters of the shaft are not critical as long as they are sufficient to serve their purposes.

The drift is run between the shafts and as much as is possible it is constructed outside of the resource body to prevent the extraction of uranium and to minimize affecting the water table of the resource body. The drift is run above, below or along the resource body and as close to the resource body as is possible. The positioning of the drift in relation to the ore body is done in such a manner as to minimize affecting the hydrostatic pressure and the water table of the ore body. Thus, the drift is generally run through that portion of rock outside of the resource body which is least permeable. Therefore, the geology surrounding a resource body is the primary factor which determines whether the drift is run above, below or along the side of a resource body. FIG. 1 shows the placement of shafts 1 and the running of a drift 2 along a portion of the front of a resource body 3. To minimize the footage of long holes drilled from the drift into the resource body, the drift is run as close to the resource body as is possible.

It is preferred that the drift be run in front of a uranium roll front where the sand is generally less permeable and therefore more stable. When the drift is run through loosely consolidated, water saturated sands, it is preferred that blasting energy be avoided in order to lessen the risk of the sands collapsing. In such instances, the preferred method for developing the drift is to dig the sand or rock out of the face, for example, through the use of mechanical digging means or through the use of hydraulic mining means. When the drift is run through impermeable formations, then blasting energy can be used if desired.

The drift must be developed in such a manner as to minimize the disturbance of the underground hydrostatic pressure while preserving the underground water tables. Thus, the drift must be sealed either naturally, by driving them throgh impermeable formations, or by physical means. Due to the loose consolidation of the rock through which the drift is generally run, the sealing should occur as the drift is being constructed or in advance of the drift construction. The sealing can be done in advance of the drift development by drilling short long holes into the face through which the drift is being developed and injecting a sealer into these holes. Alternatively, the ground water may be controlled during the construction of the drift by drilling short drainage holes in advance of the drift to allow the water to drain from the sands. This water is collected and pumped to the surface where it may be stored in a dam or pond. A drainage ditch should be laid in the bottom of the drift and the drift itself must be run slightly uphill at approximately ½ of 1 percent grade, but not to exceed a 20 percent grade, to allow any water seeping into the drift to drain away from the face. The water drains into a sump where the sand and silt will be allowed to settle and clear water pumped to the surface. Any suitable lining can be used for the drainage ditch, for example, split concrete pipe. The drift must be supported to prevent its collapse. When it is necessary to seal the drift then it is preferred that the sealing and supporting be done in one step.

A preferred method for both sealing and supporting the drift is the application of shotcrete. Prior to the application of the shotcrete, the walls should be clean with no dust or powder smoke and they should be wet or damp. Moreover, the shotcrete is applied prior to any sand sloughing occurring. The extruding nozzle used to apply the shotcrete is held at least about 2 feet from the wall but not more than about 5 feet from the wall. A circular motion is used in its application with the application of the shotcrete beginning at the foot of the rib and working up. The entire drift, i.e., floor, ribs, toes and back is shotcreted. The amount of shotcrete applied to a drift will be dependent upon the strength desired. For example, three inches of properly mixed and applied shotcrete has a strength equal to six inch steel sets positioned every three feet, and six inches of shotcrete is equal in strength to eighteen inches of poured concrete. Generally, the shotcrete is applied to obtain a thickness of from about three to about six inches. If for some reason shotcrete cannot be used on the drift, then conventional techniques, such as special ring timbering for ground support and grouting to obtain hydrostatic control, must be used.

Although the floor of the drift may be shotcreted, either rail or wood planking may be required to protect it from being broken up by the movement of drilling, pumping, mining or shotcreteing equipment.

The diameter of the drift must be sufficient to allow the miners to use their equipment. An inside diameter of from about 8 to about 12 feet after shotcreteing will generally be sufficient. Depending upon the diameter of the drift, about every 15 to about 40 feet, the drift will be widened in order to create a station from which long holes will be drilled. Drifts having diameters less than about 12 feet, will generally require the creation of drilling stations so that there will be sufficient room to accomplish the construction of the long holes. The spacing of the long holes, and thus the spacing of the stations, is dependent upon the lithology, porosity and permeability of the resource body.

Once a section of the drift has been completed, the process of drilling the long holes into the resource body should begin. Again, the development of the long holes must be in such a manner as to minimize the disturbance of the hydrostatic pressure and to preserve the water tables. To achieve this effect, conventional drills may be used, for example, percussion or rotary drills. While the hole is being drilled, drilling muds or gelatins are used to seal the hole in order to keep the ground water out of the hole. Percussion drills may sufficiently compact the sands around the drill hole to seal the ground water out, thereby eliminating the need for the drilling muds or gelatins. The use of rotary drills enables the tubing for the long holes to be injected inside the drill rod and left in place as the drill rod is withdrawn. Regardless of the drill used, the lead steel of the drill should be equipped with guides and the length of each long hole should not exceed 300 feet in order to ensure the straight drilling of the holes.

Immediately after the drilling of the long hole, a pipe, preferably a polyvinyl chloride (PVC) pipe or a fiberglass pipe, is inserted into the length of the hole. The type of pipe used is not critical as long as the pipe is able to withstand the pressures of the resource body and it can withstand the recovery solutions which are conducted through it. The collar of the pipe is cemented where it enters the drift and a control valve is attached to the drift end of the long hole. A control valve may be connected to each long hole or one valve may be used to control the flow of the recovery solution through several long holes if sufficient control of the recovery solution through the resource body can be obtained. After the cemented collar has hardened, the control valve is closed and the next long hole is drilled. The pipe may be perforated prior to its insertion into the length of the hole or it may be perforated after insertion, for example, through the use of a water jet cutter. It is preferred that the pipe is perforated after its insertion and that the sealed walls of the long hole are perforated at the same time the pipe is.

It is preferred that the long hole and its pipe be perforated at an angle whch is 90° to the flow of the recovery solution through the resource body. Since the horizontal permeability of most resource bodies will exceed the vertical permeability, generally, the long hole and its pipe will be perforated at a vertical attitude in relationship to the resource body. Although the diameter of the pipe is not critical it should be sufficient to enable a water jet cutter to be inserted. An inside diameter of about 2 inches is generally sufficient. The number and placement of the perforations in each long hole are done in a manner as to cause maximum exposure of the resource body to the recovery solutions being injected and recovered through the long holes.

It is preferable that the long holes which are drilled for the recovery of the recovery solutions have natural drainage and that the recovery holes be above the underground pumping station. If the recovery long holes are not above the underground pump station then auxiliary pumps must be used.

The long holes should be analyzed in order to determine the lithology of the resource body. By probing and logging each long hole, it is possible to more completely understand the lithology, porosity and permeability of a specific portion of the resource body. These analyses will determine the amount of separation between recovery and injection long holes, the spacing and direction of each of the long holes so as to optimize the area of the resource body contacted by the leaching solutions. FIG. 2 is a schematic representation of the placement of three long holes 4 into the resource body 3. To the extent possible, the placement of the long holes 4 into barren portions 5 of the resource body is avoided.

Although the number and spacing of the long holes will vary from deposit to deposit, FIG. 3 is schematic representation of a layout of the drift and long holes for the leaching of a one level roll front uranium resource body. Drift 2, which runs along the front of a resource body 3, is widened about every forty feet for the purpose of creating drilling stations 6. Longholes 4, 7 and 8 are drilled from each of the drilling stations into the resource body. Three long holes are drilled in the same vertical plane from each drilling station into the resource body. All of the long holes are reasonably parallel and straight so that their attitude vertically and horizontally will most effectively penetrate the host stratum for maximum exposure of the uranium to the recovery solution. Each of the long holes is lined with PVC pipe and both the pipe and the long hole are perforated by a water jet cutter. The placement of the perforations 9 is such as to maximize the exposure of the uranium contained in the resource body to the recovery solution. In this section of the resource body long holes 4 and 8 are initially used an injection long holes and long holes 7 are used as recovery long holes. If necessary to obtain maximum exposure of the resource body to the recovery solution, additional drilling stations 10 and long holes 11 may be constructed. Long holes 11 can then be used as recovery long holes and long holes 4, 7 and 8 as injection long holes. The recovery solutions used are delivered from the surface to the drift and long holes through piping (not shown) contained in shaft 1. The recovered recovery solutions are pumped in pipes (not shown) from the long holes through the drift and through shaft 1 to the surface. An underground pump (not shown), which is located in the drift, is used to pump the recovered solutions to the surface.

The number of drifts and long holes developed is dependent upon the configuration of the resource body to be leached. For example, when the resource body occurs as a substantially one level deposit, then generally only one drift need be constructed and it is preferred that it is run as parallel and as close as is possible to the resource body, but outside of the mineralized zone. In such an instance, the long holes will be drilled essentially horizontally into the resource body, for example, as shown in FIG. 3. When the resource body consists of two levels of ore bodies a variety of configurations are possible. For example, a drift may be run parallel to each level of ore body, and the injection and recovery long holes drilled from each of the drifts into the ore body which parallels the drift.

Figure 4:
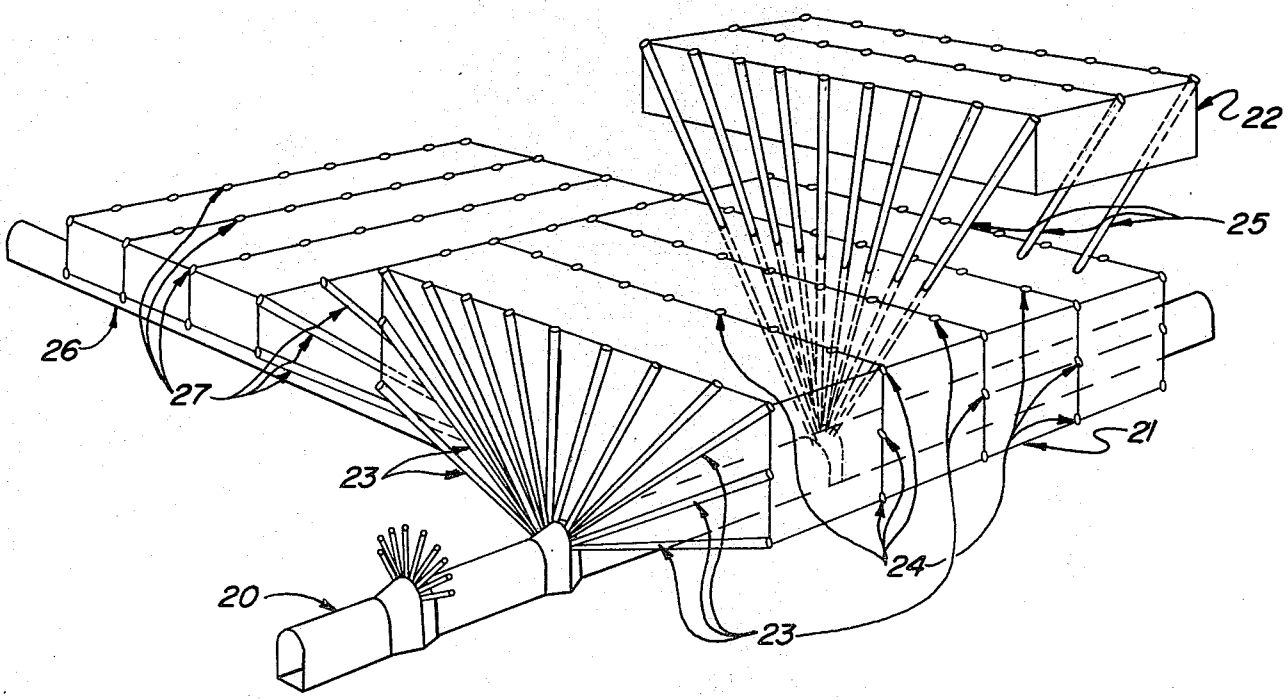
FIG. 4 is a schematic layout of drifts and long holes for the underground leaching of multilayered resource bodies.

Alternatively, a drift is developed parallel to, above or below the lower level ore body and long holes are drilled from this drift into both zones of ore bodies, for example, see FIG. 4. FIG. 4 depicts a schematic layout of drifts and long holes which could be used in an underground in situ leaching of a multilayered resource body. Drift 20 is developed in Precambrian rock and runs below two levels of resource bodies 21 and 22. A series of longholes 23, 24 and 25 are drilled in a fan like configuration up into each of the resource bodies. The longholes are lined with PVC pipe, perforated and control valve installed to control the flow of solutions through the long holes. Each series of long holes, which are about 25 feet apart, alternate for the injection and recovery long holes, for example, long holes of series 23 are used as injection long holes and long holes of series 24 are used as recovery long holes. Alternatively, the long holes of each of the series can be utilized as injection and recovery long holes. As the leaching of the resource body continues it may be desirable to change the flow of the recovery solution through the resource body. This can be done by altering or ceasing the rate of flow of the recovery solution through some of the long holes or by changing the function of a long hole from that of an injection long hole to a recovery long hole or vice versa.

By drilling the injection and recovery long holes 23 and 24 into the lower level resource body 21 and leaching this resource body first, it is possible to analyze the results of this leach when drilling the long holes 25 for the upper resource body 22. The long holes 25 are cored to the top of the lower resource body 21 and the cores analyzed to determine the effectiveness of the leach of resource body 21. The composition of the recovery solutions used to leach resource body 21 and/or the flow of the recovery solution through resource body 21 can then be altered as needed to maximize the leaching of uranium from that resource body. Long holes 25 are drilled further into the upper resource body 22. The long holes are lined with PVC pipe and that portion of the long holes and pipes extending in the upper resource body are perforated. These long holes are constructed and used in a similar manner to long holes 23 and 24 used to leach the lower resource body 21.

A second drift 26 which runs perpendicular to drift 20 is developed below another resource body with long holes 27 being constructed and used in a similar manner as the long holes of drift 20. The drifts 20 and 26 have a diameter of about 12 feet and are widened to about 15 feet at the drilling stations.

Figure 5:
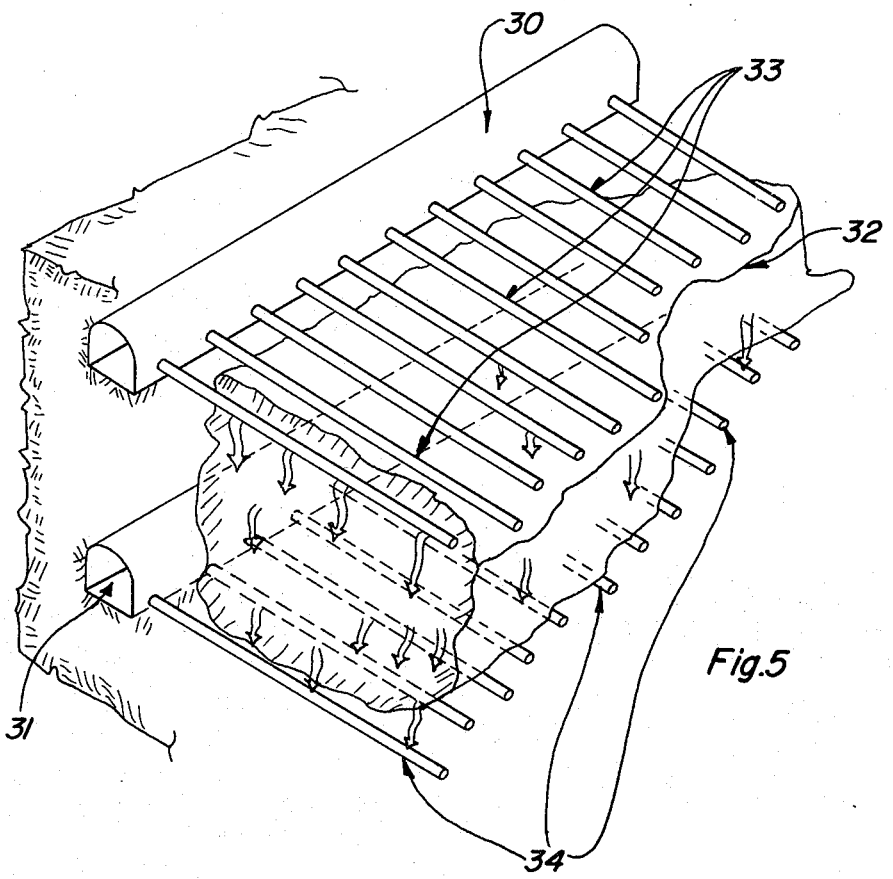
FIG. 5 is a schematic representation of an underground leaching of a resource body from an upper level of injection long holes to a lower level of injection long holes.

Alternatively, two levels of development drifts may be run parallel to the upper level and the lower level, respectively, of a resource body with the recovery long holes for both portions of the resource body being drilled from the lower level drift and the injection holes for both portions being drilled from the upper level drift, for example, as shown in FIG. 5. FIG. 5 is a cross section view of a relatively thick uranium resource body. Drifts 30 and 31 are developed parallel to the resource body 32 but outside of the resource body, with drift 30 being parallel to the upper portion of the resource body and drift 31 being parallel to the lower portion of the resource body. Long holes 33 and 34 are developed from each drift into the upper and lower portions, respectively, of the resource body. The recovery solution are injected into the upper long holes 33 and subsequently recovered from the lower long holes 34.

A wide variety of leaching combinations are also possible and the particular combination is again dependent upon the particular resource body. The leaching may be conducted horizontally from long hole to long hole; it may be conducted vertically from long hole to long hole with the injection long holes extending from the top of the drift and the recovery long holes extending from the bottom of the drift; and the leaching may be conducted horizontally from long hole to long hole when the drift is run below or above the ore bed. In the latter circumstance the long holes will be at a vertical attitude into the resource body. It is also possible to leach from drift to drift; however, leaching from drift to drift will not allow as much control over the flow of the leaching solution through the resource body as the use of long holes.

The entire developement and construction of the shafts, drifts and long holes is constructed in such a manner as to minimize any effect on the underground hydrostatic pressure or water tables. The injection and the recovery of recovery solutions is to be conducted in such a manner as to maintain the hydrostatic pressure around the outer periphery of the resource body and to control the hydrostatic pressure of that portion of the resource body being leached in order to maintain a fluid saturation of the sand of the resource body so that the flow of recovery solution through the resource body can be controlled. In order to cause the flow of the recovery solution through the resource body, a pressure differential is created between the injection and the recovery long holes. Generally, the recovery solution will be injected at a pressure which is greater than the hydrostatic pressure of the resource body and will be recovered through long holes having a head pressure less than the hydrostatic pressure of the resource body.

Figure 6:
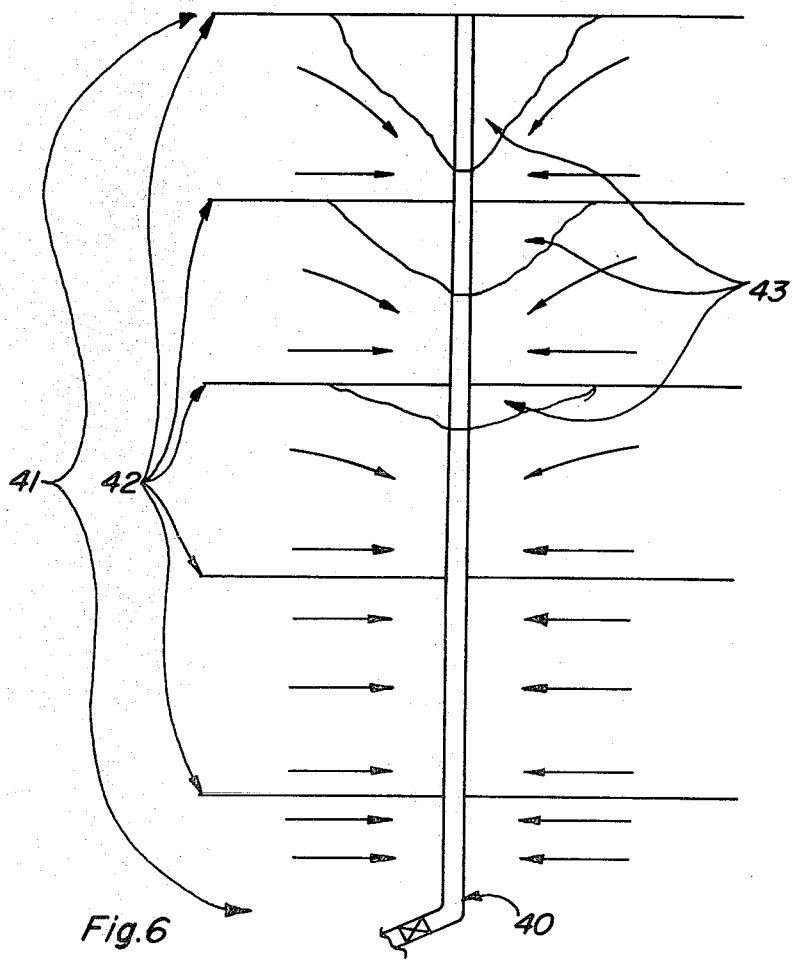
FIG. 6 is a schematic representation of a coning effect which can result from too rapid of a recovery of the recovery solutions from the resource body.

Since the lithology, porosity, permeability and transmissivity of the resource body are not homogeneous, the production rates from the different long holes will vary. Therefore, it is necessary to have the capability to measure the head pressure on each recovery hole. From these measurements it is possible to maintain sufficient hydrostatic pressure to maintain fluid saturation of the sands in that zone of the resource body being leached by varying the injection pressure of the different long holes and/or by controlling the recovery rate of the recovery long holes. The injection pressure and recovery rate of the long holes are controlled by long hole control valves. An example of the effect of uncontrolled recovery is the drawing of the recovery solutions out of a section of the resource body too rapidly. This may cause a cone to form in the sands around the long hole causing a reduction in the head pressure and upsetting the hydrostatic pressure of the resource body. This may result in the resource body not being adequately leached. This effect is schematically illustrated in FIG. 6 wherein the head pressure of the recovery long hole 40 is too low causing a rapid rate of flow of the recovery solution through the long hole and the resource body 41. The existence of layers of impermeable rock 42 contained within the resource body and the rapid rate of flow of the recovery solution creates cone shaped areas 43 within the resource body. The area of the cones 43 are not being adequately permeated by the recovery solution. The primary factor in determining the proper flow rate of the recovery solutions through the long holes is the transmissivity of that section of the resource body being leached. The control over the pressure is obtained by valves on the long holes.

Figure 7:
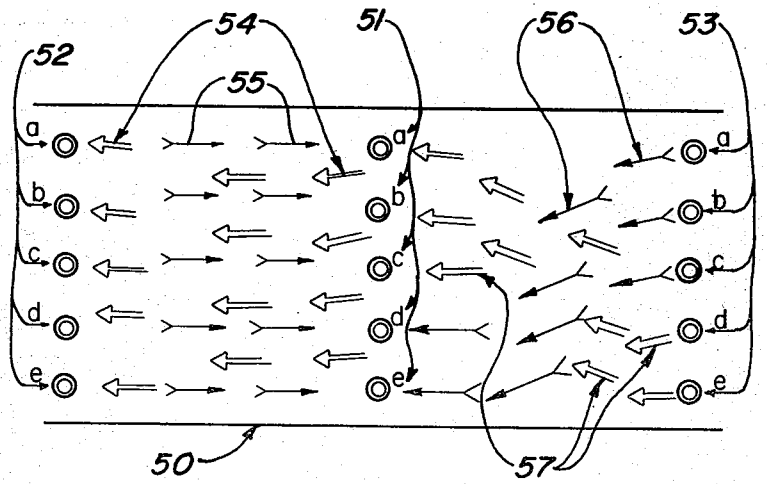
FIG. 7 is a schematic representation of possible flow patterns of the recovery solution through the resource body.

The use of valves on the long holes enable the function of a long hole to be changed, i.e., from that of an injection long hole to a recovery long hole and vice versa, which results in a change in direction of the flow of the recovery solution. FIG. 7 shows a reversal in the change of the flow of the recovery solution. Initially, the recovery solution is injected into the resource body 50 through long holes 51*a–e* and recovered from long holes 52*a–e*, the flow of the recovery solution is depicted by arrows 54. The valves to long holes 51*a–e* and 52*a–e* are shut off and the recovery fluid is injected through long holes 52*a–e*. The valves on long holes 51*a–e* are opened to create a pressure differential causing the recovery solution to flow toward these long holes; the flow of the recovery solution is depicted by arrows 55. The valved long holes can also effect the portions of the resource body which are leached. FIG. 6 gives an example of one way of affecting that flow. By injecting the recovery solution through long holes 53*a*, 53*b* and 53*c* and recovering it through long holes 51*d* and 51*e* a cross flow pattern depicted by arrows 56 is obtained. Similarily, the recovery fluid can be injected through long holes 53*d* and 53*e* and recovered through long holes 51*a*, 52*b* and 53*c*; the flow of the recovery solution is depicted by arrows 57.

The leaching operation may begin as soon as a section of the drift with its respective injection and recovery long holes has been completed. The recovery solution used for the leaching generally consists of two stages of injection, i.e., oxidizing the uranium leaching. Because the uranium is present in the resource body in a variety of oxidation states, it is generally desirable to first condition the resource body in order to obtain a higher percentage of the uranium present in higher oxidation states which are more soluble in solution. Thus, the initial leaching solution is generally more oxidizing in nature and contains a low concentration of uranium leaching solution. Any known oxidants used in the leaching of uranium ore bodies can be utilized. Preferred oxidants include oxygen and hydrogen peroxide. If the uranium resource body should contain high amounts of iron pyrite, then another oxidant other than hydrogen peroxide should be used because the pyrite decomposes the hydrogen peroxide. Uranium leaching solutions used in the leaching of uranium from ore bodies are also well-known. Such solutions are generally alkaline or acidic in nature. Examples of such solutions include ammonium nitrate and sulfuric acid. The particular composition of the uranium leaching solution is dependent upon the composition of the resource body being leached. As the recovery solution is injected into the resource body the concentration of uranium leaching solution is increased and the amount of oxidizing agent is decreased.

Initially, the concentration of uranium in the recovered leaching solution will be low during the time that the area of the resource body is being conditioned with a primarily oxidizing recovery solution. The concentration of uranium contained in the recovery solution will increase as the content of uranium leaching solution is increased. The uranium concentration will remain relatively stable until the uranium of the resource body begins to be depleted. At that point, the concentration of the uranium in the recovery solution will begin to fall off until all the uranium which can be leached is recovered. The grade of the recovered solution will vary from lows of a few parts of uranium per million parts of recovery solution to as high as 400 or 500 parts of uranium per million parts of recovery solution.

After the uranium has been leached from the resource body, the resource body is rehabilitated. The rehabilitation can be readily accomplished by decreasing the hydrostatic pressure of the resource body allowing ground water to encroach into the resource body and flushing the recovery solutions out of the resource body through the long holes. The recovered ground water is then processed to remove unwanted contaminants and reinjected into the resource body. The process is continued until the recovery solutions have been removed from the resource body. The rehabilitation can also be done without the use of ground water by injecting water through injection long holes into the resource body, recovering it, processing it to remove contaminants and reinjecting. It may be desirable to initially inject a solution which will neutralize the uranium leaching solution contained in the resource body and then continue with the rehabilitative process.

The recovery solutions are conducted to and from the surface of the mining site and the long holes by pipes. The recovered solution containing the uranium values is pumped to the surface of the mine and subsequently processed for the recovery of the uranium values. It is preferred that the processing of the uranium values occurs at the mining site. Conventional techniques, such as ion exchange or solvent extraction can be used to recover the desired uranium values.

After the mining of the resource body is complete, the mine can be readily reclaimed, for example, by perforating the walls of the drift and totally back filling the mine, if required by law. The mine can be back filled with rock which was brought to the surface initially as a result of digging the drift. Alternatively, the drift is not back filled and may be utilized as underground storage space for a wide variety of items, such as water, oil or natural gas.

The process of the present invention will produce vary few radiation problems. This underground in situ leaching process leaves the radioactive solids in place so that the miners are not working with or exposed to the resource body and its radioactive decay products. Due to the closed system of injecting the recovery solution in pipes and recovering the recovery solution from pipes only a minimal amount of the radioactive gases will be exposed to the atmosphere. Any radioactive gas in the recovery solution will have a very short half life of from about 12 seconds to about 4½ minutes. The effect of any radioactive gases which may escape the system can be readily diluted by a good ventilation system and exhausted from the mine, thereby negating any radioactive hazards. The process does not produce mine dumps nor produce radioactive mill tailings which must be disposed, thereby further reducing any radiation danger which is normally associated with uranium mining processes.

Although the process of the present invention has been described in terms of the underground in situ leaching of uranium resource bodies, it is to be understood that it is applicable to all minerals which are weakly soluble in aqueous solutions or can be made weakly soluble by the injection of a solution or agent. This process can be used to leach such minerals of deposits located within permeable sedimentary or igneous rocks which are associated with geochemical interfaces or stratiform mineral accumulations when such deposits are located below the water table. Examples of such minerals include copper, silver, nickel, gold, rare earth metals and molybdenum. The same factors which govern the placement of shafts, drifts and long holes and the conduction of the recovery solution through a uranium resource body govern the underground in situ leaching of other mineral deposits. Obviously, the recovery solutions will be selected in accordance with the type of mineral deposit and specific mineral or minerals sought to be recovered.

It is to be further understood that the process is applicable to underground in situ leaching of hydrocarbons. Since hydrocarbons are not weakly soluble in aqueous solutions, appropriate recovery solutions will have to be used.

What is claimed is:

1. An underground in situ leaching process for the recovery of mineral values which are capable of being weakly soluble in aqueous solutions from deposits of such minerals which are located within permeable sedimentary or igneous rocks which are associated with geochemical interfaces or stratiform mineral accumulations when such deposits are located below a water table comprising:

establishing a drift close to the resource body in such a manner as to minimize any effect on the subsurface water and hydrostatic pressure;

drilling long holes from the drift into the resource body and perforating the long holes, wherein the drilling and perforating are done in such a manner as to minimize effects on the subsurface water and hydrostatic pressure;

injecting a recovery solution into the resource body through some of the long holes;

recovering the recovery solution the resource body through long holes which are not being used as injection long holes; and conducting the injection and recovery of the recovery solution in such a manner as to maintain the hydrostatic pressure of the outer periphery of the resource body and to control the hydrostatic pressure of that portion of the resource body being leached in order to maximize the exposure of the resource body to the recovery solution thereby maximizing the recovery of the mineral from the resource body.

2. An underground in situ leaching process for the recovery of uranium values from a uranium resource body comprising:

establishing a drift close to the resource body in such a manner as to minimize any effect on the subsurface water and hydrostatic pressure;

drilling long holes from the drift into the resource body and perforating the long holes, wherein the drilling and perforating are done in such a manner as to minimize any effect on the subsurface water and hydrostatic pressure;

injecting a recovery solution into the resource body through some of the long holes;

recovering the recovery solution from the resource body through long holes which are not being used as injection long holes; and conducting the injection and recovery of the recovery solution in such a manner as to maintain the hydrostatic pressure of the outer periphery of the resource body and to control the hydrostatic pressure of that portion of the resource body being leached in order to maximize the exposure of the resource body to the recovery solution thereby maximizing the recovery of the uranium from the uranium resource body.

3. The process of claim 2 wherein the uranium resource body is a roll front deposit and wherein the drift is run substantially parallel to the roll front along the edge of the resource body and primarily outside of resource body.

4. The process of claim 1 or claim 2 wherein the establishment of and access to the drift is via one or more shafts wherein the shafts are conducted in a manner to minimize any effect on subsurface water and hydrostatic pressure.

5. The process of claim 1 or claim 2 wherein the drift is run below the resource body.

6. The process of claim 1 or claim 2 wherein the drift is run above the resource body.

7. The process of claim 1 or claim 2 wherein the drift is run along a side of the resource body.

8. The process of claim 1 or claim 2 wherein the recovery solution consists initially of a conditioning solution which places the minerals of the resource body into a form more soluble in the leaching solution and wherein the recovery solution consists subsequently of a leaching solution which is capable of solubilizing the mineral values contained within the resource body.

9. The process of claim 1 or claim 2 wherein the hydrostatic pressure within that portion of the resource body being leached is controlled by the attachment of valves to the long holes in order to control the flow of the recovery solution through the long holes.

10. The process of claim 9 wherein the recovery solution is caused to flow from the injection long holes to the recovery long holes by creating a pressure differential between the injection and recovery long holes and wherein the pressure differential creates a flow of the recovery solution which maximizes the exposure of that portion of the resource body being leached to the recovery solution.

11. The process of claim 2 wherein the recovery solution consists initially and primarily of an oxidizing solution and which subsequently consists of a leaching solution capable of solubilizing the uranium values contained within the uranium resource body.

12. An underground in situ leaching process for the recovery of mineral values which are capable of being weakly soluble in aqueous solutions from deposits of such minerals which are located within permeable sedimentary or igneous rocks which are associated with geochemical interfaces or stratiform mineral accumulations and wherein such deposits are located below a water table comprising:

establishing through the use of one or more shafts a drift close to the mineral resource body in such a manner as to minimize any effect on the subsurface water and hydrostatic pressure;

drilling long holes from the drift into the mineral resource body, inserting pipes into the long holes, cementing the pipes to a wall of the drift, perforating the pipes and long holes, and attaching a control valve to the drift end of the long hole pipes, wherein the drilling, perforating, inserting of the pipes and attaching of the control valves are done in such a manner as to minimize any effect on the subsurface water and hydrostatic pressure;

injecting a recovery solution into the mineral resource body through some of the long holes;

recovering the recovery solution from the resource body through long holes which are not being used as injection long holes; and conducting the injection and recovery of the recovery solution in such a manner as to maintain the hydrostatic pressure of the outer periphery of the mineral resource body and to control the hydrostatic pressure of that portion of the resource body being leached in order to maximize the exposure of the resource body to the recovery solution thereby maximizing the recovery of the mineral values from the mineral resource body.

13. The process of claim 12 wherein the mineral values and hydrocarbons and wherein the mineral resource body is a hydrocarbon resource body.

14. An underground in situ leaching process for the recovery of uranium values from a uranium resource body comprising:

establishing through the use of one or more shafts a drift close to the uranium resource body in such a manner as to minimize any effect on the subsurface water and hydrostatic pressure;

drilling long holes from the drift into the uranium resource body, inserting pipes into the long holes, cementing the pipes to a wall of the drift, perforating the pipes and long holes and attaching a control valve to the drift end of each of the long hole pipes, wherein the drilling, perforating, inserting the pipes and attaching of the control valves are done in such a manner as to minimize any effect on the subsurface water and hydrostatic pressure;

injecting an oxidizing agent into the uranium resource body through some of the long holes;

injecting a uranium leaching solution into the uranium resource body through the same long holes into which the oxidizing solution was injected;

recovering the oxidizing agent and uranium leaching solution from the resource body through long holes which are not being used as injection long holes; and conducting the injection and recovery of the oxidizing agent and uranium leaching solution in such a manner as to minimize any effect on the hydrostatic pressure of the outer periphery resource body and to control the hydrostatic pressure within that portion of the resource body being leached in order to maintain the water saturation of the resource body and to maximize the exposure of the resource body to the oxidizing and acid leaching solutions thereby maximizing the recovery of the uranium from the resource body.

15. The process of claim 1 or claim 14 wherein the recovered recovery solution containing the mineral values is processed for the recovery of the mineral values.

16. The process of claim 15 wherein the oxidizing agent is a solution.

17. The process of claim 15 wherein the oxidizing agent is oxygen.

18. The process of claim 2 or claim 14 wherein the recovered recovery solution containing uranium values is processed to recover the uranium values.

19. The process of claim 12 or claim 14 wherein the recovery solution is caused to flow from the injection long holes to the recovery long holes by creating a pressure differential between the injection and recovery long holes and wherein the pressure differential creates a flow of the recovery solution which maximizes the exposure of that portion of the resource body being leached to the recovery solution.

20. The process of claim 12 or claim 14 wherein the perforation of the long holes and their pipes is done at an angle which is 90° to the flow of the recovery solution through the resource body.

* * * * *